US007874120B2

(12) United States Patent
Ohata et al.

(10) Patent No.: US 7,874,120 B2
(45) Date of Patent: Jan. 25, 2011

(54) CONNECTING STRUCTURE FOR STEEL FRAME COLUMNS AND STEEL FRAME GIRDERS

(75) Inventors: Eiichi Ohata, Shizuoka (JP); Kazuo Wakasugi, Chuo-ku (JP); Koichi Hirosawa, Chuo-ku (JP); Kenji Narita, Chuo-ku (JP)

(73) Assignees: Itec Corporation, Shizuoka (JP); SECO Corporation, Tokyo (JP)

( * ) Notice: Subject to any disclaimer, the term of this patent is extended or adjusted under 35 U.S.C. 154(b) by 103 days.

(21) Appl. No.: 12/246,438

(22) Filed: Oct. 6, 2008

(65) Prior Publication Data

US 2009/0223166 A1 Sep. 10, 2009

(30) Foreign Application Priority Data

Mar. 5, 2008 (JP) ..... 2008-054377

(51) Int. Cl.
*E04H 12/00* (2006.01)

(52) U.S. Cl. ..... 52/655.1; 52/653.1

(58) Field of Classification Search ..... 52/653.1, 52/655.1, 656.1, 236.3, 236.6, 236.7, 272, 52/167.1, 289, 230, 187, 838, 831, 837; 211/191, 211/186, 189; 403/387, 335, 336, 252, 255, 403/262, 264, 403, 406, 104, 108, 231, 347, 403/379, 382, 393
See application file for complete search history.

(56) References Cited

U.S. PATENT DOCUMENTS 712,299 A * 10/1902 Howland-Sherman ..... 52/301
1,744,600 A * 1/1930 Wilcox ..... 403/230
2,675,895 A * 4/1954 Loewenstein ..... 52/236.3
2,943,716 A * 7/1960 Babcock ..... 52/653.1

(Continued)

FOREIGN PATENT DOCUMENTS

JP 59-85051 A 5/1984

(Continued)

*Primary Examiner*—Robert J Canfield
*Assistant Examiner*—Babajide Demuren
(74) *Attorney, Agent, or Firm*—Browdy and Neimark, PLLC

(57) ABSTRACT

Sufficient yield strength is achieved against tensile, compressive and shearing forces working on steel frame columns and steel frame girders by using simply configured connective fittings to reduce costs and construction periods. For this purpose, a connective structure of highly rigid steel frame columns and steel frame girders formed by connecting steel frame columns and steel frame girders each having a web part and flange parts with connective fittings is provided. Each of the connective fittings has a bottom plate part and, on a surface of the bottom plate part, side plate parts which rise at a substantially right angle to the bottom plate part and have inserting areas extending farther than a tip of the bottom plate part in the state of rising at the substantially right angle. On the other hand, slit holes are formed in the flange parts of the steel frame columns in the area where the flange parts cross the flange parts of the steel frame girders, the inserting areas of the side plate parts are inserted into the slit holes, the inserting areas of the side plate parts are fixed in a state of opposing the web parts of the steel frame columns, and the bottom plate parts of the connective fittings are fixed in a state of opposing the flange parts of the steel frame girders.

7 Claims, 6 Drawing Sheets

U.S. PATENT DOCUMENTS

| | | | | | |
|---|---|---|---|---|---|
| 3,438,663 | A | * | 4/1969 | Colson | 403/230 |
| 3,716,957 | A | * | 2/1973 | Bernardi | 52/633 |
| 3,716,959 | A | * | 2/1973 | Bernardi | 52/838 |
| 4,014,089 | A | * | 3/1977 | Sato et al. | 29/525.11 |
| 4,074,947 | A | * | 2/1978 | Matake et al. | 403/231 |
| 4,406,562 | A | * | 9/1983 | Nasi | 403/347 |
| 6,059,482 | A | * | 5/2000 | Beauvoir | 403/262 |
| 6,073,405 | A | * | 6/2000 | Kasai et al. | 52/283 |
| 6,138,427 | A | * | 10/2000 | Houghton | 52/655.1 |
| 6,237,303 | B1 | * | 5/2001 | Allen et al. | 52/838 |
| 6,474,902 | B1 | * | 11/2002 | Beauvoir | 403/403 |
| 6,739,099 | B2 | * | 5/2004 | Takeuchi et al. | 52/167.1 |
| 7,178,296 | B2 | * | 2/2007 | Houghton | 52/261 |
| 2002/0100229 | A1 | * | 8/2002 | Chen et al. | 52/167.1 |
| 2006/0144006 | A1 | * | 7/2006 | Suzuki et al. | 52/655.1 |

FOREIGN PATENT DOCUMENTS

| | | | | |
|---|---|---|---|---|
| JP | 07-102635 | A | | 4/1995 |
| JP | 2002356912 | A | * | 12/2002 |
| KR | 2006066931 | A | * | 6/2006 |

* cited by examiner

CONNECTING STRUCTURE FOR STEEL FRAME COLUMNS AND STEEL FRAME GIRDERS

BACKGROUND OF THE INVENTION

1. Field of the Invention

The present invention relates to a connective structure for steel frame columns and steel frame girders built of H beams.

2. Description of the Related Art

Known connective structures for H beam-built steel frame columns and steel frame girders include one which uses T-shaped fittings, so-called split Ts, as described in JP-A-07-102635 cited below. According to JP-A-07-102635, the flange parts of each connective fitting have plural bolt inserting holes, an inclined face is formed from the bolt inserting holes of the connective fittings in contact with steel frame columns toward their ends, and the flange parts are tension-connected to the steel frame columns by fastening with high strength bolts pressed through the bolt inserting holes in a state of being held in contact with the flange parts of the steel frame columns. On the other hand, the web part of each connective fitting has plural bolt inserting holes, and the web parts are connected to steel frame girders by fastening with high strength bolts pressed through the bolt inserting holes in a state of being held in contact with the flange parts of the steel frame girders. The connective fittings according to JP-A-07-102635, when tensile forces work on them to subject the flange parts of the connective fitting to bending deformation, turn pivoting on the bolt inserting holes in contact with the flange parts of the steel frame columns and accordingly no reaction of lever works, enabling the tensile stress to be eased.

There is also known what uses racket-shaped connective fittings, so-called paddle bolts, as disclosed in JP-A-59-85051 cited below. According to JP-A-59-85051, each connective fitting has a bolt part at one end and the other end forms a planar part having a bolt inserting hole. The bolt parts of the connective fittings are pressed through the bolt inserting holes bored in the flange parts of steel frame columns and fastened to be tension-connected to the steel frame columns. On the other hand, the planar parts of the connective fittings are connected to steel frame girders by being fastened with high strength bolts pressed through the bolt inserting holes in a state of being in contact with the flange parts of the steel frame girders. With the connective fittings of JP-A-59-85051, even if the plumbing accuracy of the steel frame columns is somewhat poor, dimensional adjustment can be accomplished by turning adjustive nuts screwed onto the bolt parts, making it possible to facilitate the operation and improve workability.

However, the conventional connective fittings used in the connective structures described above involve a problem that they have no sufficient yield strength against tensile, compressive and shearing forces. Especially, the web parts of split Ts and the bolt parts provided at one end each of paddle bolts are poor in yield strength against tensile and compressive forces working in the rectangular direction, involving a problem that these parts may be broken even before the tensile and compressive forces reach the web parts of steel frame columns. There is another problem that, since the connective fittings are connected on the flange parts of steel frame columns, forces from the steel frame columns are always transmitted via the flange parts of the steel frame columns. Thus, the flange parts of steel frame columns become even poorer in yield strength against the tensile and compressive forces working on them in the rectangular direction in the farther areas from the central position in their shorter side direction and, if excessively high tensile and compressive forces are transmitted to the flange parts of the steel frame columns via the connective fittings, not only the connective fittings but also the flange parts of the steel frame columns may be broken in this area. These circumstances are leading to a trend of making the connective structure greater in yield strength by building connective fittings such as split Ts and paddle bolts, tightening items such as bolts and nuts, and constituent members of steel frame columns such as flange parts of high strength steel and/or designing them greater in thickness and diameter, but the loss of yield strength due to bolt inserting holes and the like has also to be made up for, resulting in the need to use plural reinforcing members including gusset plates and reinforcing steel plates. As a consequence, the manufacturing cost of constituent members as well as the working cost and carriage cost resulting from the increased number of constituent members are rising, also entailing delays in construction schedules.

An object of the present invention, attempted in view of the above-noted problems found in conventional structures, is to provide a connective structure for steel frame columns and steel frame girders which can achieve sufficient yield strength against tensile, compressive and shearing forces working on the steel frame columns and the steel frame girders with simply configured connective fittings and contribute to reducing costs and construction periods.

SUMMARY OF THE INVENTION

A connective structure for connecting steel frame columns and steel frame girders with connective fittings according to the present invention includes a steel frame column having a web part and flange parts of which one is provided on each side of the web part, and a steel frame girder having a web part and flange parts of which one is provided on each side of the web part, wherein each of the connective fittings has a bottom plate part and a side plate part or parts on a surface of the bottom plate part which rise at a substantially right angle to the bottom plate part and have inserting areas extending farther than a tip of the bottom plate part in the state of rising at the substantially right angle, the flange parts of the steel frame column have slit holes formed in areas where the column crosses the flange parts of the steel frame girder, and the inserting areas of the side plate parts are inserted into the slit holes, the inserting areas of the side plate parts are fixed in a state of opposing the web part of the steel frame column, and the bottom plate part of the connective fitting is fixed in a state of opposing the flange parts of the steel frame girder.

The connective structure for steel frame columns and steel frame girders according to the invention enables tensile, compressive and shearing forces working on the steel frame columns and the steel frame girders via connective fittings to be smoothly transmitted and sufficient yield strength against these forces to be thereby obtained. As a result, there is no need to build connective fittings and constituent members of high strength steel and/or designing them greater in thickness and diameter or to use plural reinforcing members to give the connective structure sufficient yield strength, and the costs and construction periods can be thereby reduced.

DESCRIPTION OF THE EXEMPLARY EMBODIMENT

Figure 1:
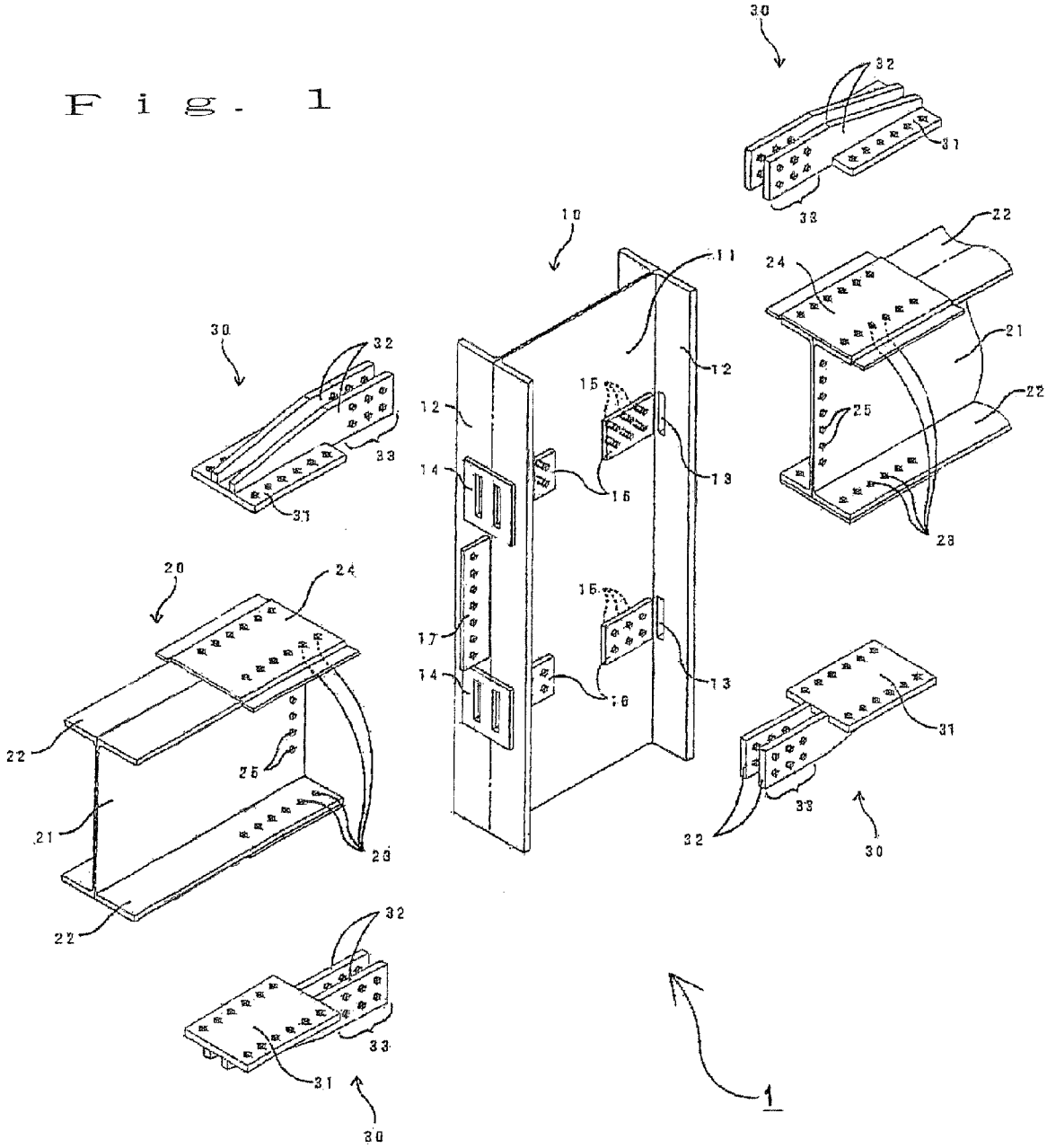
FIG. 1 shows a perspective view of members constituting a connective structure according to the invention.

An exemplary embodiment of the present invention will be described below with reference to the accompanying drawings. FIG. 1 shows a perspective view of members constituting a connective structure of this exemplary embodiment. As shown in FIG. 1, a connective structure 1 is provided with an H beam-built steel frame column 10 and an H beam-built steel frame girder 20 crossing the steel frame column 10, and connects them with connective fittings 30. The steel frame column 10 has a web part 11 and flange parts 12 disposed on two sides of the web part 11. The steel frame girder 20 has a web part 21 and flange parts 22 disposed on two sides of the web part 21.

Two slit holes 13 are formed in each of the flange parts 12 of the steel frame column 10 symmetrically with respect to the center in the shorter side direction of the area where it crosses the flange parts 22 of the steel frame girder 20. In order to reinforce the yield strengths of the flange parts 12 against the boring of the slit holes 13, flange reinforcing steel plates 14 having slit holes formed in parts of the flange parts 12 corresponding to the areas where the slit holes 13 are formed are disposed by welding and the like. Further, plural (two lines of three rows each here) bolt inserting holes 15 are bored in positions near the slit holes 13 in the web part 11 of the steel frame column 10. Also in the web part 11, in order to reinforce the yield strength of the web part 11 against the boring of the bolt inserting holes 15, flange reinforcing steel plates 16 having bolt inserting holes formed in parts corresponding to the areas where the bolt inserting holes are bored are disposed by welding and the like. Incidentally, the flange reinforcing steel plates 16 are arranged in positions with some spacing from the flange parts 12 to allow for the welded parts between the web part 11 and the flange parts 12 or the fillet parts. The number, size and positions of the bolt inserting holes 15 are determined on the basis of the dimensions of the steel frame column 10 and the steel frame girder 20 among other factors.

On the other hand, in the flange parts 22 of the steel frame girder 20, plural (one line of six rows here) bolt inserting holes 23 are bored in the area where they cross the flange parts 12 of the steel frame column 10 and in a position near the side ends of the flange parts 12. Also, in order to reinforce the yield strength of the flange parts 22 against the boring of the bolt inserting holes 23 in the flange parts 22, flange reinforcing steel plates 24 having bolt inserting holes formed in parts corresponding to the areas where the bolt inserting holes 23 are bored are disposed by welding and the like. Incidentally, the flange reinforcing steel plates 24 also have the function of deck sustaining plates. The number, size and positions of the bolt inserting holes 23 are determined on the basis of the dimensions of the steel frame column 10 and the steel frame girder 20 among other factors.

Figure 2:
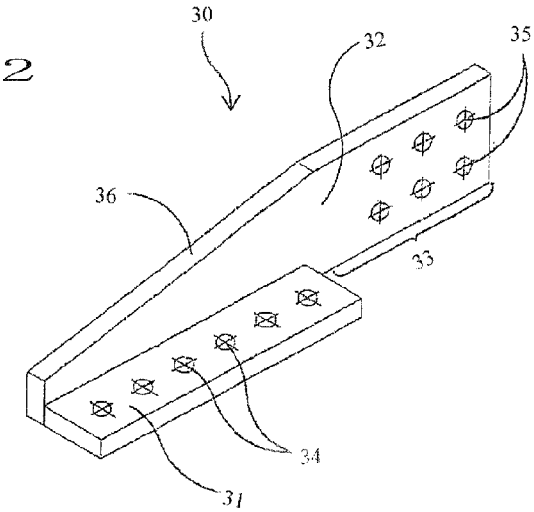
FIG. 2 shows a perspective view of an L-sectioned connective fitting pertaining to the connective structure according to the invention.
Figure 3:
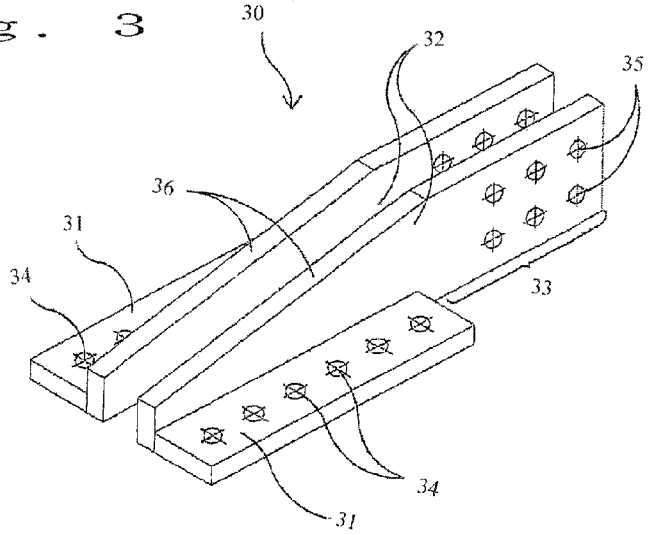
FIG. 3 shows a perspective view of L-sectioned connective fittings pertaining to the connective structure according to the invention in a state of being placed opposite each other.
Figure 4:
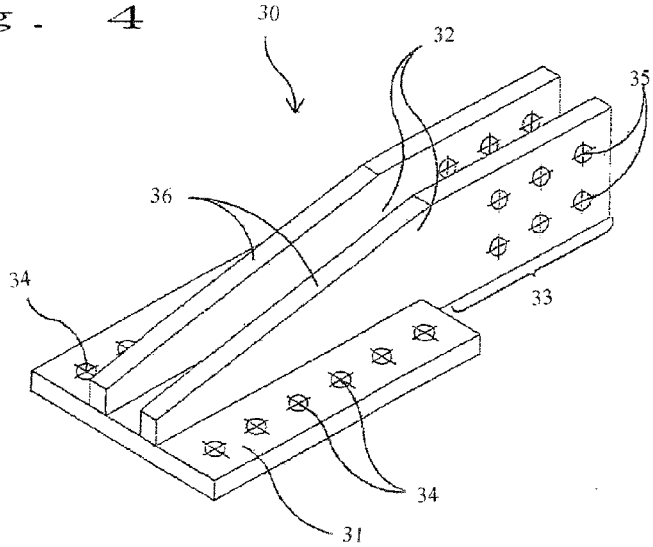
FIG. 4 shows a perspective view of a T-sectioned connective fitting pertaining to the connective structure according to the invention.

Further, each of the connective fittings 30 has a bottom plate 31 and a side plate or plates 32, all flat shaped, and is integrally formed by welding, casting and the like. FIG. 2 through FIG. 4 show perspective views of connective fittings pertaining to the connective structure embodying the invention. Each of the connective fittings 30 may be an L-shaped item including one bottom plate 31 and one side plate 32 rising at a right angle from one end of the bottom plate 31 as shown in FIG. 2 and FIG. 3, or a T-shaped one including one bottom plate 31 and two side plates 32 rising at a right angle from the bottom plate 31 as shown in FIG. 4. Both are used in a state in which the rear faces of the side plates 32 oppose each other. Each of the side plates 32 has a substantially rectangular inserting area 33 extending beyond the bottom plate 31. The area of each side plate 32 other than the inserting area 33 is formed into a slant cut part 36 of which the shorter side is the other end of the side plate 32 than the inserting area 33 and the longer side extends toward the inserting area 33. The area which would have remained unless the part 36 had been cut is hardly susceptible to the tensile and compressive forces transmitted from the steel frame girder 20 to the steel frame column 10, and the absence of this area contributes to reducing the weight of the connective fittings 30. Furthermore, plural (one line of six rows here) bolt inserting holes 34 are formed in the bottom plate 31 of each connective fitting 30 and plural (two lines of three rows here) bolt inserting holes 35 are formed in each side plate 32. The numbers, sizes and positions of the bolt inserting holes 34 and 35 are determined on the basis of the dimensions of the steel frame column 10 and the steel frame girder 20 among other factors.

Figure 5:
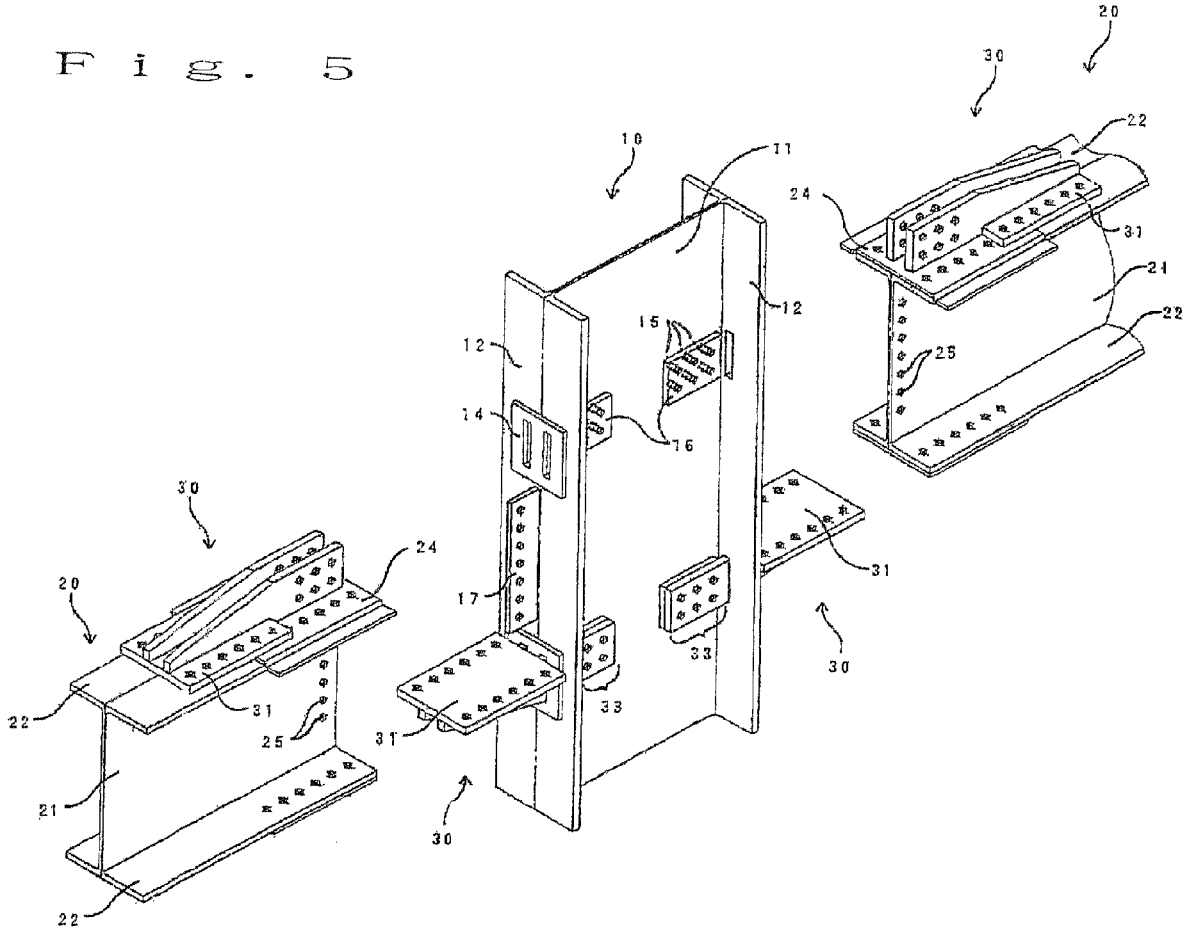
FIG. 5 shows a perspective view of a connecting procedure pertaining to the connective structure according to the invention.
Figure 6:
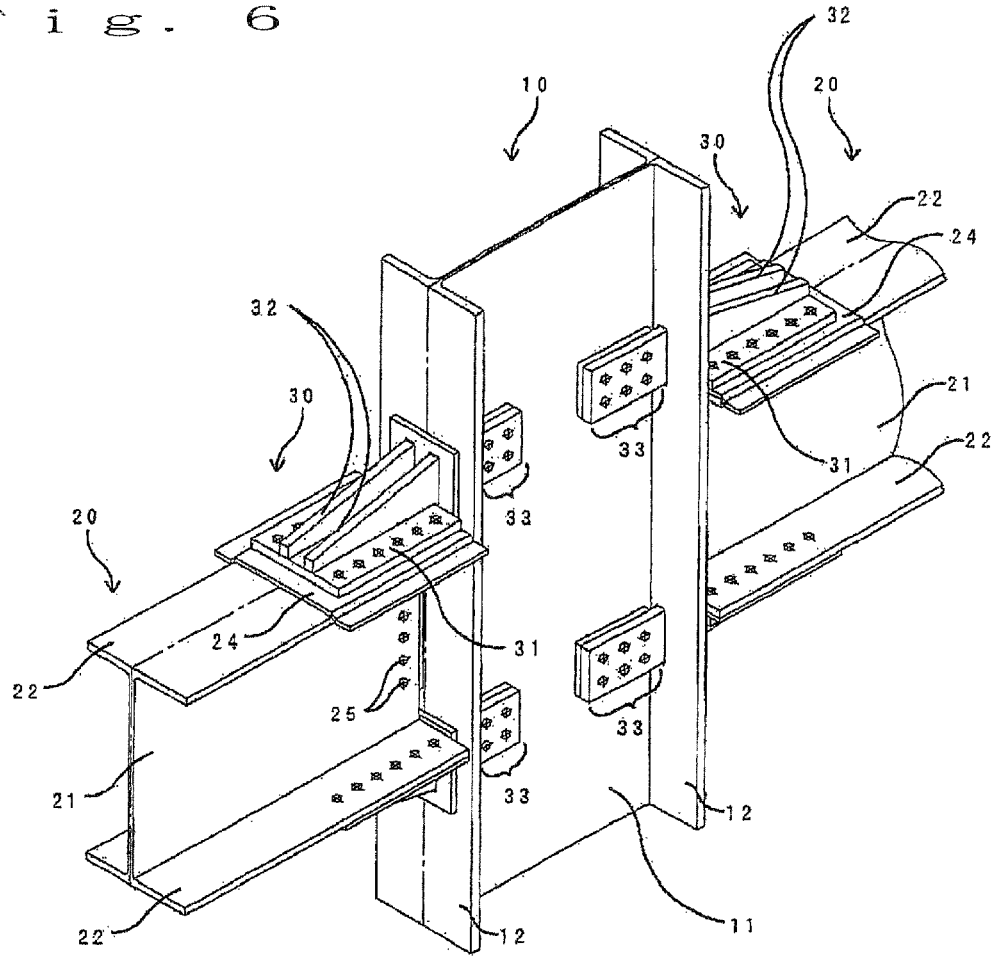
FIG. 6 shows another perspective view of the connecting procedure pertaining to the connective structure according to the invention.

The procedure of connecting the connective structure 1 of this exemplary embodiment configured as described above will now be described. FIG. 5 and FIG. 6 show perspective views of the connecting procedure pertaining to the connective structure of this embodiment. First, as shown in FIG. 5, in a state in which the inserting areas 33 of the connective fittings 30 supporting the under-faces of the flange parts 22 of the steel frame girder 20 from underneath are inserted into the slit holes of the flange reinforcing steel plates 14 provided on the flange parts 12 of the steel frame column 10 and the slit holes 13 and held against the web part 11 of the steel frame column 10 via the flange reinforcing steel plates 16, the bolt inserting holes bored in the inserting areas 33 positioned on both faces of the web part 11 of the steel frame column 10, the flange reinforcing steel plates 16 and the web part 11 are aligned with one another, these members are fastened with high strength bolts inserted into them, and the connective fittings 30 are connected with the two faces of the web part 11 of the steel frame column 10 in-between. In this way, the side plates 32 of the connective fittings 30 supporting the under-faces of the flange parts 22 of the steel frame girder 20 are connected to the web part 11 of the steel frame column 10, and the flange parts 22 of the steel frame girder 20 can be readily guided.

Then, after guiding the under-faces of the flange parts 22 of the steel frame girder 20 toward the bottom plates 31 of the connective fittings 30, in a state in which the bottom plate 31 is brought into contact with the flange parts 22 of the steel frame girder 20 via the flange reinforcing steel plates 24, the bolt inserting holes bored in the bottom plate 31, the flange reinforcing steel plates 24 and the flange parts 22 are aligned with one another, these members are fastened with high strength bolts inserted into them, and the under-faces of the flange parts 22 of the steel frame girder 20 are connected to the bottom plates 31. The bottom plates 31 of the connective fittings 30 which support the under-faces of the flange parts 22 of the steel frame girder 20 from underneath are connected to the under-faces of the flange parts 22 of the steel frame girder 20.

After that, as shown in FIG. 6, the inserting areas 33 of each connective fitting 30 disposed on the upper face of the flange part 22 of the steel frame girder 20 are inserted into the slit holes and the slit holes 13 of the flange reinforcing steel plates 14 provided on the flange parts 12 of the steel frame column 10, the bolt inserting holes bored in the inserting areas 33 positioned on the two faces of the web part 11 of the steel frame column 10, the flange reinforcing steel plates 16 and the web part 11 are aligned with one another in a state in which these areas are opposed to the web part 11 of the steel frame column 10 via the flange reinforcing steel plates 16, and these members are fastened with high strength bolts inserted into them and connected with the two faces of the web part 11 of the steel frame column 10 in-between. In this way, the side plates 32 of the connective fittings 30 disposed on the upper faces of the flange parts 22 of the steel frame girder 20 are connected to the web part 11 of the steel frame column 10.

Figure 7:
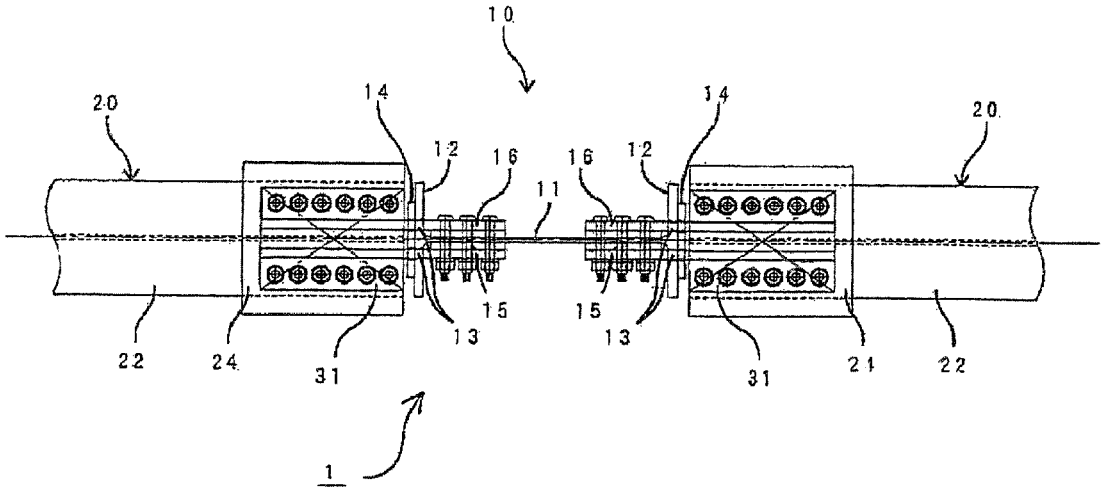
FIG. 7 shows a plan of a state in which connective fittings pertaining to the connective structure according to the invention are connected.
Figure 8:
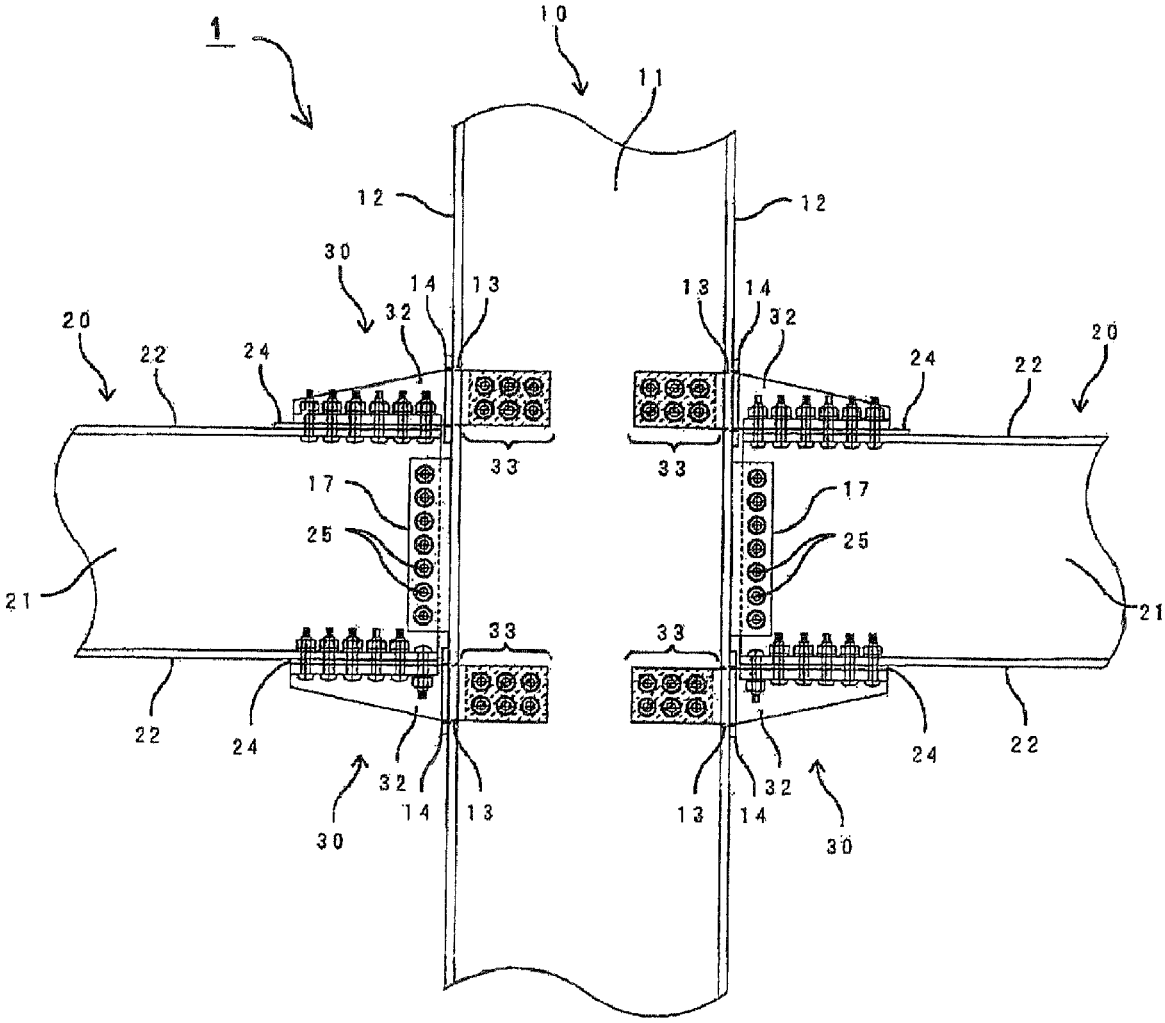
FIG. 8 shows an elevation of the state in which connective fittings pertaining to the connective structure according to the invention are connected.
Figure 9:
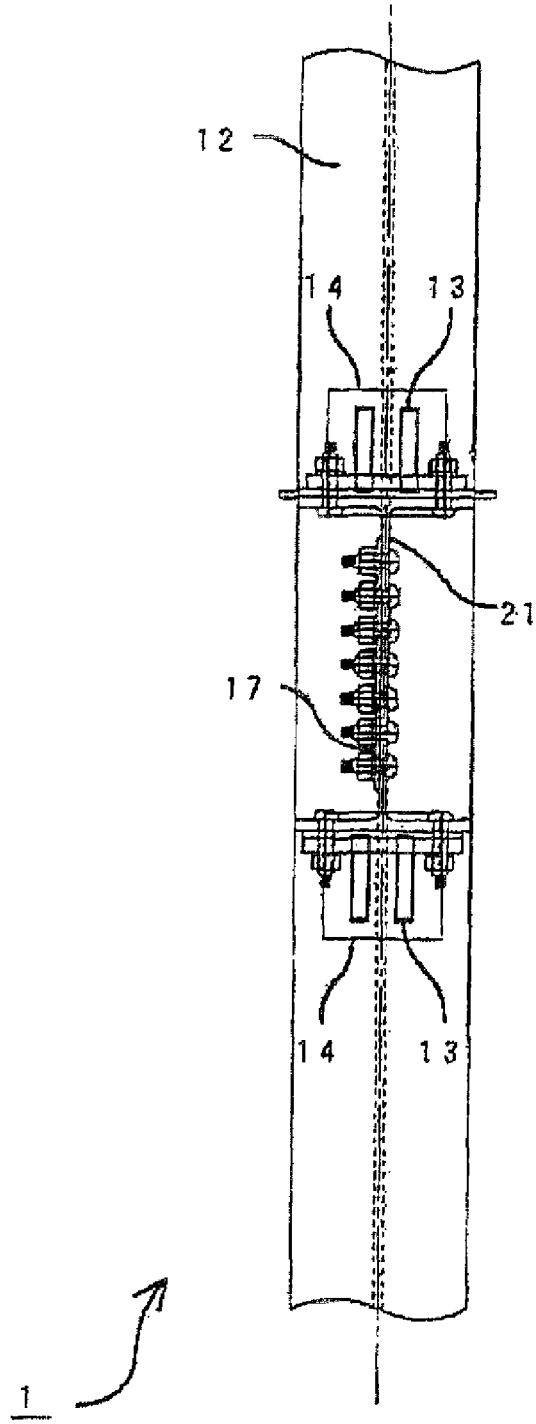
FIG. 9 shows a profile of the state in which connective fittings pertaining to the connective structure according to the invention are connected.

Finally, the bolt inserting holes in the bottom plate 31, the flange reinforcing steel plates 24 and the flange parts 22 are aligned with one another in a state in which the bottom plates 31 of the connective fittings 30 disposed on the upper faces of the flange parts 22 of the steel frame girder 20 are opposed to the flange parts 22 of the steel frame girder 20 via the flange reinforcing steel plates 24, these members are fastened with high strength bolts inserted into them, and the upper faces of the flange parts 22 of the steel frame girder 20 are connected to the bottom plate 31. In this way, the bottom plates 31 of the connective fittings 30 disposed on the upper faces of the flange parts 22 of the steel frame girder 20 are connected to the upper faces of the flange parts 22 of the steel frame girder 20. FIG. 7 shows a plan of a state in which connective fittings are connected to the steel frame columns and steel frame girders of this embodiment of the invention; FIG. 8 shows an elevation; and FIG. 9 shows a profile of the same.

In the connective structure 1, the inserting areas 33 of connective fittings are inserted into the slit holes 13 formed in the flange parts 12 of the steel frame column and connection is thereby accomplished in a state in which the inserting areas 33 are opposed to the web part 11, therefore this area is not affected by the tensile and compressive forces working on the flange parts 12 of the steel frame column 10 in the rectangular direction. It is also possible to enable each of the tensile, compressive and shearing forces working on the steel frame column 10 and the steel frame girder 20 to be smoothly transmitted by having the bottom plates 31 of the connective fittings 30 and the side plates 32 divert the forces into the rectangular direction. Thus, the tensile, compressive and shearing forces transmitted onto the flange parts 22 of the steel frame girder 20 are transmitted to fixed positions in the inserting areas 33 of the side plates 32 formed upright from the bottom plate 31 at a right angle to the bottom plate 31, and transmitted from the side plates 32 to the web part 11 of the steel frame column 10. On the other hand, the tensile, compressive and shearing forces transmitted from over the flange parts 11 of the steel frame column 10 to the side plates 32 are transmitted to fixed positions in the bottom plate 31 and further transmitted from the bottom plate 31 onto the flange parts 22 of the steel frame girder 20.

Further, the bottom plate 31, when subjected to a shearing force in a direction at a right angle to the flange parts 22 of the steel frame girder 20, can smoothly transmit the force to the side plates 32 which are greater in yield strength against shearing forces than the bottom plate 31, and accordingly can restrain impacts on the bottom plate 31 and the flange parts 22 of the steel frame girder 20. Moreover when the bottom plate 31 is subjected to tensile and compressive forces in the same direction as the flange parts 22 of the steel frame girder 20, the forces can be smoothly transmitted to the side plates 32 while restraining their impacts on the side plates 32 and the web part 11 of the steel frame column 10 by being transmitted via the bottom plate 31 which is greater in yield strength against tensile and compressive forces than the side plates 32.

Also, when the side plates 32 are subjected to a shearing force in the same direction as the web part 11 of the steel frame column 10, the force can be smoothly transmitted to the bottom plate 31 while restraining its impacts on the bottom plate 31 and the flange parts 22 of the steel frame girder 20 by being transmitted via the side plates 32 which are greater in yield strength against shearing forces than the bottom plate 31. Moreover, when side plates 32 are subjected to tensile and compressive forces in a direction at a right angle to the steel frame column 10 and the web part 11, the side plates 32 can smoothly transmit the force to the bottom plate 31 which is greater in tensile and compressive forces than the side plate 32, and the impacts on the side plates 32 and the web part 11 of the steel frame column 10 can be restrained.

As described so far, the connective structure 1 of this embodiment can ensure sufficient yield strength by smoothly transmitting the tensile, compressive and shearing forces working on the steel frame column 10 and the steel frame girder 20 via the connective fittings 30. As a result, there is no need to build connective fittings and constituent members of high strength steel and/or designing them greater in thickness and diameter or to use plural reinforcing members to make the connective structure having sufficient yield strength, and the costs and construction periods can be thereby reduced.

The connective structure 1 of this embodiment is provided, by welding and the like, with gusset plates 17 having plural (one line of six rows here) bolt inserting holes in a position near the center in the shorter side direction of the flange parts 12 of the steel frame column 10 which cross the web part 21 of the steel frame girder 20, while bolt inserting holes 25 are formed in the web part 21 of the steel frame girder 20 in positions matching the bolt inserting holes of the gusset plates 17. The gusset plates 17 and the web part 21 mutually align the respective bolt inserting holes 25, are fastened with high strength bolts pressed through the respective bolt inserting holes and are connected to the web part 21 of the steel frame column 20. In this way the gusset plates 17 connect the flange parts 12 of the steel frame column 10 to the web part 21 of the steel frame girder 20 while the connective fittings 30 connect the web part 11 of the steel frame column 10 to the flange parts 22 of the steel frame girder 20 in the positions where the steel frame column 10 and the steel frame girder 20 cross each other, therefore the tensile, compressive and shearing forces working on the steel frame column 10 and the steel frame girder 20 can be transmitted in a well balanced manner, and the impacts of these forces on the steel frame column 10, the steel frame girder 20 and the connective fittings 30 can be restrained.

Although the present invention has been described with reference to an exemplary embodiment thereof illustrated in the accompanying drawings, it is obvious to persons skilled in the art that various alterations and modifications are possible without deviating from the true spirit and scope of the invention. The invention covers such alterations and modifications as well.

What is claimed is:

1. A connective structure for connecting steel frame columns and steel frame girders, comprising:

a steel frame column having a web part and flange parts of which one is provided on each side of the web part, and a steel frame girder having a web part and flange parts of which one is provided on each side of the web part, connective fittings connected between the steel frame column and the steel frame girder in the connective structure, wherein each of the connective fittings has a bottom plate part and side plate parts on a surface of the bottom plate part which rise at a substantially right angle to the bottom plate part and have inserting areas extending farther than a tip of the bottom plate part in the state of rising at the substantially right angle, the flange parts of the steel frame column have slit holes formed in areas where the column crosses the flange parts of the steel frame girder, and the inserting areas of the side plate parts are inserted into the slit holes, the inserting areas of the side plate parts are fixed in a state of opposing the web part of the steel frame column, and the bottom plate part of the connective fitting is fixed in a state of opposing the flange parts of the steel frame girder.

2. The connective structure for connecting steel frame columns and steel frame girders according to claim 1, wherein the slit holes in the flange parts of the steel frame column are formed in two symmetric positions with respect to the center of the flange parts in a shorter side direction of the area where the flange parts cross the flange parts of the steel frame girder, and the connective fittings are disposed in positions where the inserting areas of the side plate parts are inserted into the slit holes.

3. The connective structure for connecting steel frame columns and steel frame girders according to claim 1, wherein a plurality of bolt inserting holes are formed in the bottom plate part of the connective fitting and the flange parts of the steel frame girder in respectively corresponding parts, a plurality of bolt inserting holes are formed in side plate parts of the connective fitting and the web part of the steel frame column in respectively corresponding parts, and the constituent members are fastened by using clamp fittings against the plurality of bolt inserting holes respectively formed in the bottom plate part of the connective fitting and the flange parts of the steel frame girder, and side plate parts of the connective fitting and the web part of the steel frame column.

4. The connective structure for connecting steel frame columns and steel frame girders according to claim 1, wherein each of the connective fittings is provided with one of the bottom plate parts and one of the side plate parts formed rising at a right angle from one end of the bottom plate part.

5. The connective structure for connecting steel frame columns and steel frame girders according to claim 1, wherein each of the connective fittings is provided with one of the bottom plate parts and two of the side plate parts formed rising at a right angle from the bottom plate part.

6. A connective structure for connecting steel frame columns and steel frame girders, comprising:

a steel frame column having a web and flanges connected to an edge of the web, and perpendicular to the web, one of the flanges being provided on each side of the web, and a steel frame girder having a web and flanges connected to an edge of the web, and perpendicular to the web, one of the flanges being provided on each side of the web, connective fittings connected between the steel frame column and the steel frame girder in the connective structure, wherein each of the connective fittings has a bottom plate and at least two side plates connected to a surface of the bottom plate which rise at a substantially right angle to the bottom plate, the at least two side plates having inserting sections that extend farther than an edge of the bottom plate, the flanges of the steel frame column having slit holes formed in areas where the column crosses the flanges of the steel frame girder, and wherein when the inserting sections of the side plates are inserted into the slit holes of one of the flanges, the inserting sections of the side plates are fixedly connected to opposing surfaces of the web of the steel frame column, and the bottom plate of the connective fitting abuts against the one of the flanges of the steel frame girder.

7. A connective structure for connecting steel frame columns and steel frame girders, comprising:

a steel frame column having a web and flanges connected to an edge of the web, and perpendicular to the web, one of the flanges being provided on each side of the web, and a steel frame girder having a web and flanges connected to an edge of the web, and perpendicular to the web, one of the flanges being provided on each side of the web, connective fittings connected between the steel frame column and the steel frame girder in the connective structure, wherein each of the connective fittings has a bottom plate and a side plate connected to a surface of the bottom plate which rises at a substantially right angle to the bottom plate, the side plate having an inserting section that extends farther than an edge of the bottom plate, the flanges of the steel frame column having slit holes formed in areas where the column crosses the flanges of the steel frame girder, and wherein two connective fittings are connected to one another and the inserting sections of the side plates of the two connective fittings are inserted into the slit holes of one of the flanges, such that the inserting sections of the side plates of the two connective fittings are fixedly connected to opposing surfaces, respectively, of the web of the steel frame column, and the bottom plate of the connective fittings abut against the one of the flanges of the steel frame girder.

* * * * *